US009810192B1

(12) United States Patent
Idicheria et al.

(10) Patent No.: US 9,810,192 B1
(45) Date of Patent: Nov. 7, 2017

(54) METHOD AND APPARATUS FOR CONTROLLING OPERATION OF AN INTERNAL COMBUSTION ENGINE

(71) Applicant: GM GLOBAL TECHNOLOGY OPERATIONS LLC, Detroit, MI (US)

(72) Inventors: Cherian A. Idicheria, Novi, MI (US); Paul M. Najt, Bloomfield Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 45 days.

(21) Appl. No.: 15/097,442

(22) Filed: Apr. 13, 2016

(51) Int. Cl.

| | |
|---|---|
| ***F02P 17/12*** | (2006.01) |
| ***F02P 23/04*** | (2006.01) |
| ***F02M 27/04*** | (2006.01) |
| ***F02P 9/00*** | (2006.01) |
| ***F02D 41/30*** | (2006.01) |
| ***F02D 41/00*** | (2006.01) |
| ***H01T 13/02*** | (2006.01) |

(52) U.S. Cl.
CPC ..... *F02P 17/12* (2013.01); *F02D 41/0047* (2013.01); *F02D 41/30* (2013.01); *F02M 27/042* (2013.01); *F02P 9/007* (2013.01); *F02P 23/04* (2013.01); *H01T 13/02* (2013.01)

(58) Field of Classification Search
CPC . F02P 23/04; F02P 17/12; F02P 9/007; H01T 13/02
USPC ..... 123/143 B; 313/141, 143, 118; 445/7
See application file for complete search history.

(56) References Cited

U.S. PATENT DOCUMENTS

2012/0112620 A1* 5/2012 Lykowski ..... F02P 23/04 313/141
2016/0157332 A1* 6/2016 Ban ..... H05H 1/52 315/246
2016/0305393 A1* 10/2016 Idicheria ..... H01T 13/20

FOREIGN PATENT DOCUMENTS

WO 2015130655 A1 9/2015

* cited by examiner

*Primary Examiner* — Mahmoud Gimie
(74) *Attorney, Agent, or Firm* — Quinn IP Law

(57) ABSTRACT

An internal combustion engine is described and includes a combustion chamber formed by cooperation of a cylinder bore formed in a cylinder block, a cylinder head and a piston. A plasma ignition controller is electrically connected to a groundless barrier discharge plasma igniter that includes a tip portion disposed to protrude into the combustion chamber. A current sensor is disposed to monitor secondary current flow between the plasma ignition controller and the groundless barrier discharge plasma igniter. The plasma ignition controller is disposed to execute a plasma discharge event. A controller is disposed to monitor a magnitude of the secondary current flow via the current sensor during the plasma discharge event. The controller includes an instruction set executable to evaluate integrity of the groundless barrier discharge plasma igniter based upon the magnitude of the secondary current flow during the plasma discharge event.

20 Claims, 2 Drawing Sheets

METHOD AND APPARATUS FOR CONTROLLING OPERATION OF AN INTERNAL COMBUSTION ENGINE

TECHNICAL FIELD

This disclosure relates to an internal combustion engine configured with a direct injection fuel system and plasma igniters, and control and monitoring thereof.

BACKGROUND

Known spark-ignition (SI) engines introduce an air/fuel mixture into each cylinder that is compressed during a compression stroke and ignited by a spark plug. SI engines may operate in different combustion modes, including, by way of non-limiting examples, a homogeneous SI combustion mode and a stratified-charge SI combustion mode. SI engines may be configured to operate in a homogeneous-charge compression-ignition (HCCI) combustion mode, also referred to as controlled auto-ignition combustion, under predetermined speed/load operating conditions. HCCI combustion is a distributed, flameless, kinetically-controlled auto-ignition combustion process with the engine operating at a dilute air/fuel mixture, i.e., lean of a stoichiometric air/fuel point, with relatively low peak combustion temperatures, resulting in low NOx emissions.

Known plasma ignition systems may facilitate operation at lean air/fuel ratios, including operation in HCCI and other combustion modes. Known plasma ignition systems employ ignition plugs or igniters in place of spark plugs to ignite a fuel/air cylinder charge.

SUMMARY

An internal combustion engine is described and includes a combustion chamber formed by cooperation of a cylinder bore formed in a cylinder block, a cylinder head and a piston. A plasma ignition controller is electrically connected to a groundless barrier discharge plasma igniter that includes a tip portion disposed to protrude into the combustion chamber. A current sensor is disposed to monitor secondary current flow between the plasma ignition controller and the groundless barrier discharge plasma igniter. The plasma ignition controller is disposed to execute a plasma discharge event. A controller is disposed to monitor a magnitude of the secondary current flow via the current sensor during the plasma discharge event. The controller includes an instruction set executable to evaluate integrity of the groundless barrier discharge plasma igniter based upon the magnitude of the secondary current flow during the plasma discharge event.

The above features and advantages, and other features and advantages, of the present teachings are readily apparent from the following detailed description of some of the best modes and other embodiments for carrying out the present teachings, as defined in the appended claims, when taken in connection with the accompanying drawings.

BRIEF DESCRIPTION OF THE DRAWINGS

One or more embodiments will now be described, by way of example, with reference to the accompanying drawings, in which.

DETAILED DESCRIPTION

Figure 1:
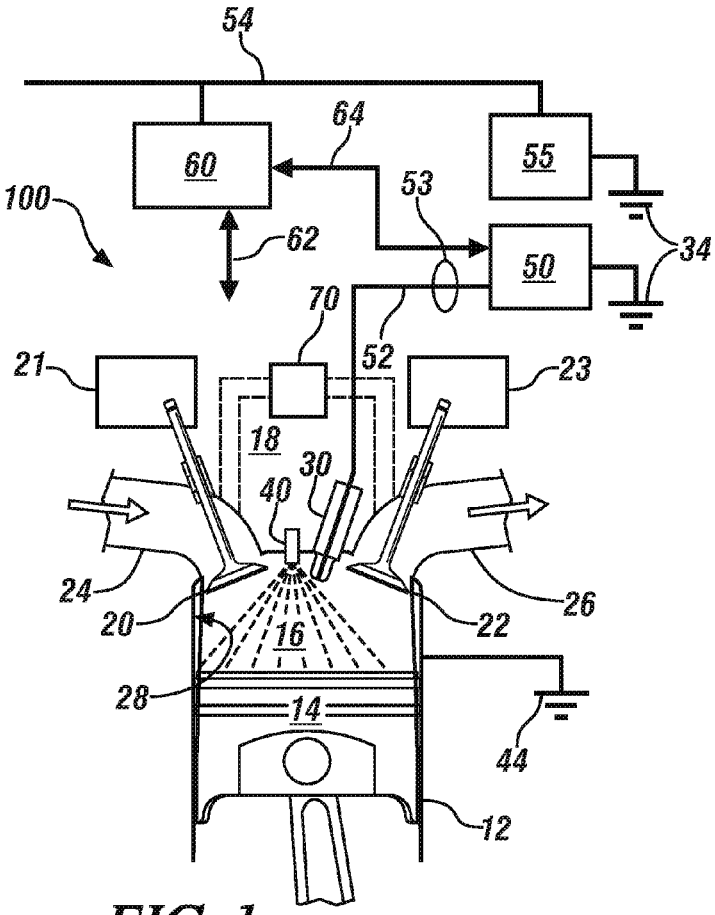
FIG. 1 schematically illustrates a cross-sectional view of an embodiment of a single cylinder for an internal combustion engine including an in-cylinder groundless dielectric barrier-discharge plasma igniter of a plasma ignition system, in accordance with the disclosure.

Referring now to the drawings, wherein the depictions are for the purpose of illustrating certain exemplary embodiments only and not for the purpose of limiting the same, FIG. 1 schematically illustrates a cross-sectional view of a single cylinder for a multi-cylinder internal combustion engine (engine) 100 and an associated engine controller (ECM) 60. The engine 100 includes an engine block 12 defining a plurality of cylinder bores 28 containing movable pistons 14, one of which is shown. A cylinder head 18 is disposed on a nominal top portion of the engine block 12 and a rotating crankshaft (not shown) is disposed at a nominal bottom portion of the engine block 12. Each of the cylinder bores 28 houses one of the movable pistons 14. The walls of the cylinder bore 28, a top portion of the piston 14 and an inner exposed portion of the cylinder head 18 define outer boundaries of a variable-volume combustion chamber 16 that is disposed therein. Each piston 14 mechanically couples to a connecting rod that rotatably couples to the crankshaft, and the piston 14 slidably translates within the cylinder bore 28 in reciprocating motion between a top-dead-center (TDC) position and a bottom-dead-center (BDC) position to transfer mechanical power to the crankshaft during each combustion cycle. The engine 100 preferably operates in a four-stroke combustion cycle that includes repetitively executed intake, compression, expansion and exhaust strokes, wherein the strokes are associated with translation of the piston 14 with the cylinder bore 28. Operation of the engine 100 is controlled by the ECM 60, which communicates with a fuel injection system to control fuel injection into cylinders of the engine 100, and communicates with a plasma ignition controller 50 via line 62 to control operation of a plurality of groundless dielectric barrier-discharge plasma igniters (plasma igniters) 30 that are partially disposed in-cylinder to ignite fuel-air cylinder charges. As used herein, the term "groundless" indicates absence of a discrete element or structure proximal to the plasma igniter 30 fabricated from material that is capable of electrically coupling to an electrical ground path.

The cylinder head 18 includes an intake port or runner 24 that is in fluid communication with the combustion chamber 16, with an intake valve 20 disposed within for controlling airflow into the combustion chamber 16. The cylinder head 18 also includes an exhaust port or runner 26 that is in fluid communication with the combustion chamber 16, with an exhaust valve 22 disposed within for controlling exhaust gas flow out of the combustion chamber 16. FIG. 1 shows a single intake valve 20 and a single exhaust valve 22 associated with the combustion chamber 16, but it is appreciated that each combustion chamber 16 may be configured with multiple intake valves and/or multiple exhaust valves. Engine airflow may be controlled by selectively adjusting position of a throttle valve (not shown) and adjusting openings and/or closings of the intake valves 20 and the exhaust valves 22 in relation to piston positions. An intake variable valve actuation system 21 is arranged to control openings and closings of the intake valves 20, and an exhaust variable valve actuation system 23 is arranged to control openings and closings of the exhaust valves 22. The intake and exhaust variable valve actuation systems 21, 23 may include variable cam phasing and a selectable multi-step valve lift, e.g., multiple-step cam lobes that provide two or more valve lift positions, and employ urgings of valve springs and lobes on one or more rotating camshafts that are rotatably coupled to the crankshaft, or other suitable mechanisms to effect such control. The change in valve position of the multi-step valve lift mechanism may be a discrete step change.

The cylinder head 18 may be arranged to provide structure for mounting a plurality of fuel injectors 40. Each fuel injector 40 is disposed to inject fuel into one of the combustion chambers 16. In one embodiment, the fuel injector 40 is arranged with a fuel nozzle that is disposed in a geometrically central portion of a cylindrical cross-section of the combustion chamber 16 and aligned with a longitudinal axis thereof. The fuel injector 40 fluidly and operatively couples to a fuel injection system, which supplies pressurized fuel at a flowrate that is suitable to operate the engine 100. The fuel injector 40 includes a flow control valve and a fuel nozzle that is disposed to inject fuel into the combustion chamber 16. The fuel may be any suitable composition such as, but not limited to, gasoline, ethanol, diesel, natural gas, and combinations thereof. The fuel nozzle may extend through the cylinder head 18 into the combustion chamber 16. Furthermore, the cylinder head 18 may be arranged with the fuel injector 40 and fuel nozzle disposed in a geometrically central portion of a cylindrical cross-section of the combustion chamber 16 and aligned with a longitudinal axis thereof. The fuel nozzle may be arranged in line with the plasma igniter 30 between the intake valve 20 and the exhaust valve 22. Alternatively, the cylinder head 18 may be arranged with the fuel nozzle disposed in line with the plasma igniter 30 and orthogonal to a line between the intake valve 20 and the exhaust valve 22. Alternatively, the cylinder head 18 may be arranged with the fuel nozzle disposed in a side injection configuration. The arrangements of the cylinder head 18 including the fuel nozzle and the plasma igniter 30 described herein are illustrative. Other suitable arrangements may be employed within the scope of this disclosure.

The cylinder head 18 may be arranged to provide structure for mounting the plasma igniter 30, preferably in the form of a pass-through aperture 19. Each plasma igniter 30 includes a tip portion 34 that protrudes into the combustion chamber 16 through the aperture 19. The cylinder head 18 electrically connects to an electrical ground 44. One embodiment of the plasma igniter 30 is described with reference to FIGS. 2 and 3, and preferably includes a single electrode 33 having a tip portion 34 that is encapsulated in a dielectric coating 32, wherein the electrode 33 has the tip portion 34 near a second, distal end 36 that is opposite a first end 35 that electrically connects to the plasma ignition controller 50. In one embodiment, the dielectric coating 32 has a thickness that is within a range between 1 mm and 5 mm. The plasma igniter 30 fixedly attaches to a mounting boss 31. The mounting boss 31 preferably threadably inserts through and attaches to the pass-through aperture 19 in the cylinder head 18 such that the tip portion 34 of the electrode 33 protrudes into the combustion chamber 16. The electrode 33 electrically connects to the plasma ignition controller 50 at its first end 35.

The dielectric coating 32 provides a dielectric barrier around the tip portion 34 of the electrode 33 that extends into the combustion chamber 16 when the plasma igniter 30 is in an installed position in the cylinder head 18. As such, the tip portion 34 of the electrode 33 is fully encapsulated by the dielectric material that forms the dielectric coating 32. The dielectric coating 32 may be configured in a frustoconical shape that tapers in a narrowing fashion towards the distal end 36. This example is non-limiting, and the electrode 33 and dielectric coating 32 may be otherwise shaped and/or contoured relative to the contour of the distal end 36. The distal end 36 may be shaped, for example, as a conical end, a cylindrical end, a chamfered cylindrical end, etc. Other cross-sectional shapes, e.g., oval, rectangular, hexagonal, etc., may be employed. Other configurations of groundless dielectric barrier-discharge plasma igniters may be employed with similar effect. Other non-limiting embodiments of groundless dielectric barrier-discharge plasma igniters may be found in International Application Publication Number WO 2015/130655 A1 with an International Publication Date of 3 Sep. 2015, which is also assigned to the Applicant. The dielectric material may be any suitable dielectric material capable of withstanding the temperatures and pressures that can occur in an engine combustion chamber. For example, the dielectric material may be a glass, quartz, or ceramic dielectric material, such as a high purity alumina.

Figure 3:
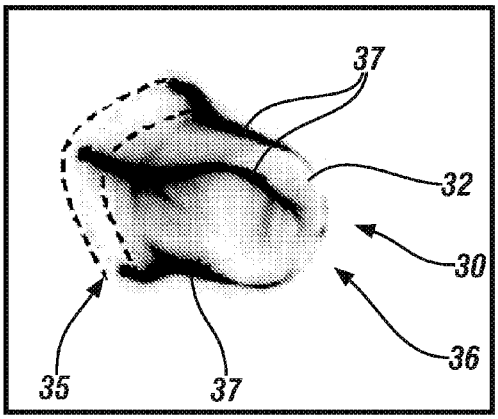
FIG. 3 schematically illustrates an isometric view of an in-cylinder groundless dielectric barrier-discharge plasma igniter that depicts a plurality of streamers generated by a single plasma discharge event when a dielectric coating encapsulating the electrode is intact, in accordance with the disclosure.
Figure 4:
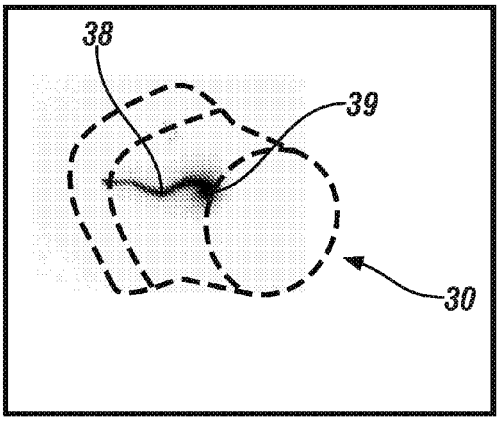
FIG. 4 schematically illustrates an isometric view of an in-cylinder groundless dielectric barrier-discharge plasma igniter that depicts a single electric arc generated by a single plasma discharge event, in accordance with the disclosure.

The plasma ignition controller 50 controls operation of the plasma igniter 30, employing electric power supplied from a power source 55, e.g., a battery. The plasma ignition controller 50 also electrically connects to the electrical ground path 44, thus forming an electrical ground connection to the cylinder head 18. The plasma ignition controller 50 electrically connects to each of the plasma igniters 30, preferably via a plurality of electrical cables 52, a single one of which is shown. The plasma ignition controller 50 includes control circuitry that generates a high-frequency, high-voltage electrical pulse that is supplied to each plasma igniter 30 via the electric cable 52 to generate a plasma discharge event that ignites fuel-air cylinder charges in response to control signals that may originate from the ECM 60. A current sensor 53 is disposed to monitor the electric cable 52 to detect electrical current that is supplied from the plasma ignition controller 50 to the plasma igniter 30 during each plasma discharge event. The current sensor 53 may employ direct or indirect current sensing technologies in conjunction with signal processing circuits and algorithms to determine a parameter that is associated with the magnitude of current that is supplied to each plasma igniter 30. Such current sensing technologies may include, by way of non-limiting embodiments, induction, resistive shunt, or Hall effect sensing technologies. One parameter of interest may include a secondary current, which is described as a magnitude of electric current flow between the plasma ignition controller 50 and each plasma igniter 30. The secondary current may be the magnitude of current flow of current associated with a plurality of plasma discharge streamers 37 during each plasma discharge event during operation absent when the dielectric coating 32 around the electrode 33 is intact, as depicted with reference to FIG. 3. The secondary current may be the magnitude of current flow associated with a single electric arc 38 during each plasma discharge event when the dielectric coating 32 around the electrode 33 has a fault, as depicted with reference to FIG. 4.

During each plasma discharge event, the plasma ignition controller 50 generates a high-frequency, high-voltage electrical pulse that is supplied to the electrode 33 via the electrical cable 52. In one example, the high-frequency, high-voltage electrical pulse may have a peak primary voltage of 100 V, secondary voltages between 10 and 70 kV, a duration of 2.5 ms, and a total energy of 1.0 J, with a frequency near one megahertz (MHz). The plasma discharge event generates one or a plurality of plasma discharge streamers 37, as best shown with reference to FIG. 3, which originate at the mounting boss 31 and propagate towards the tip portion 34. The plasma discharge streamers 37 may propagate across a surface of a longitudinal portion of the dielectric coating 32 of the electrode 33 in multiple radial locations and terminate on the distal end 36 at or near the tip portion 34. The plasma discharge streamers 37 interact with and ignite the cylinder charge, which combusts in the combustion chamber 16 to generate mechanical power. The specific details of the configuration of the plasma igniter 30, its arrangement in the combustion chamber 16, and operating parameters (peak voltage, frequency and duration) associated with electric power and timing of activation during each plasma discharge event are application-specific, and are preferably selected to achieve desired combustion characteristics within the combustion chamber 16. The plurality of plasma discharge streamers 37 generate a large discharge area for effective flame development in in-cylinder fuel/air charges that may be stoichiometric homogeneous, lean homogeneous, rich homogeneous, and/or lean/rich stratified and lean controlled auto-ignition in nature.

The engine 100 may include an exhaust gas recirculation (EGR) system 70, including a controllable EGR valve for controlling a magnitude of flow of exhaust gas from the exhaust runner 26 to the intake runner 24. The ECM 60 is configured to monitor parameters associated with operation of the engine 100 and send command signals to control systems and actuators of the engine 100, as indicated by line 62. Systems controlled by the ECM 60 include, by way of non-limiting examples, the intake and exhaust variable valve actuation systems 21, 23, the fuel injector 40, the plasma ignition controller 50 and the EGR system 70.

The engine 100 selectively operates in one of a plurality of combustion modes depending upon operating conditions. The disclosure may be applied to various engine systems and combustion cycles. In one embodiment, the engine 100 may be operably connected to a plurality of wheels disposed on one or more axles of a vehicle (not shown) to provide tractive power. For example, the engine 100 may be connected to a transmission (not shown) which may in turn rotate the one or more axles. The engine 100 may provide direct tractive power to the plurality of wheels, such as via the transmission connected to the one or more axles, or may provide power to one or more electric motors (not shown) that may in turn provide direct motive power to the plurality of wheels. In any event, the engine 100 may be configured to provide power to a vehicle by combusting fuel and converting chemical energy to mechanical energy. The engine 100 advantageously employs an embodiment of the plasma ignition system that includes the plasma ignition controller 50 and the plasma igniters 30 to facilitate stable low-temperature combustion of fuel/air cylinder charges that are highly dilute, and thus provide an alternative to a spark plug ignition system that can enhance low-temperature, dilute combustion at high combustion pressures while achieving robust lean low-temperature combustion.

In the embodiment described with reference to FIG. 1, the ECM 60 monitors inputs from engine and vehicle sensors to determine states of engine parameters. The ECM 60 is configured to receive operator commands, e.g., via an accelerator pedal and a brake pedal to determine an output torque request, from which engine control parameters and an engine torque command are derived. The ECM 60 executes control routines stored therein to determine states for the engine control parameters to control the aforementioned actuators to form a cylinder charge, including controlling throttle position, compressor boost, plasma ignition timing, fuel injection pulsewidth affecting injected fuel mass and timing, EGR valve position to control flow of recirculated exhaust gases, and intake and/or exhaust valve timing and phasing. Valve timing and phasing may include negative valve overlap (NVO) and lift of exhaust valve reopening (in an exhaust re-breathing strategy), and positive valve overlap (PVO). Engine parameters associated with a cylinder charge that are affected by individual engine control parameters may include air/fuel ratio, intake oxygen, engine mass airflow (MAF), manifold pressure (MAP) and mass-burn-fraction point (CA50 point). The air/fuel ratio may be controlled by the fuel injection pulsewidth and affects an amount of fuel injected into each combustion chamber 16 during each engine cycle. The engine mass airflow (MAF) and manifold pressure (MAP) are controlled by controlling NVO/PVO, electronic throttle control, and a turbocharger (when employed) and affects a magnitude of trapped air mass and a magnitude of residual gases in the combustion chamber 16. The intake oxygen may be controlled by the EGR valve, which controls a magnitude of external EGR during each engine cycle. The engine parameters of MAF, actual air/fuel ratio, intake oxygen, MAP and CA50 point may be directly measured using sensors, inferred from other sensed parameters, estimated, derived from engine models or otherwise dynamically determined by the ECM 60.

The terms controller, control module, module, control, control unit, processor and similar terms refer to any one or various combinations of Application Specific Integrated Circuit(s) (ASIC), electronic circuit(s), central processing unit(s), e.g., microprocessor(s) and associated non-transitory memory component in the form of memory and storage devices (read only, programmable read only, random access, hard drive, etc.). The non-transitory memory component is capable of storing machine readable instructions in the form of one or more software or firmware programs or routines, combinational logic circuit(s), input/output circuit(s) and devices, signal conditioning and buffer circuitry and other components that can be accessed by one or more processors to provide a described functionality. Input/output circuit(s) and devices include analog/digital converters and related devices that monitor inputs from sensors, with such inputs monitored at a preset sampling frequency or in response to a triggering event. Software, firmware, programs, instructions, control routines, code, algorithms and similar terms mean any controller-executable instruction sets including calibrations and look-up tables. Each controller executes control routine(s) to provide desired functions, including monitoring inputs from sensing devices and other networked controllers and executing control and diagnostic instructions to control operation of actuators. Routines may be periodically executed at regular intervals, for example each 100 microseconds during ongoing operation. Alternatively, routines may be executed in response to occurrence of a triggering event. Communication between controllers, and communication between controllers, actuators and/or sensors may be accomplished using a direct wired link, a networked communication bus link 54, a wireless link or another suitable communications link. Communication includes exchanging data signals in any suitable form, including, for example, electrical signals via a conductive medium, electromagnetic signals via air, optical signals via optical waveguides, and the like. Data signals may include signals representing inputs from sensors, signals representing actuator commands, and communications signals between controllers. The term 'model' refers to a processor-based or processor-executable code and associated calibration that simulates a physical existence of a device or a physical process. As used herein, the terms 'dynamic' and 'dynamically' describe steps or processes that are executed in real-time and are characterized by monitoring or otherwise determining states of parameters, and regularly or periodically updating the states of the parameters during execution of a routine or between iterations of execution of the routine.

As previously described, the plasma discharge streamers 37 may propagate across a surface of a longitudinal portion of the dielectric coating 32 of the electrode 33 in multiple radial locations and terminate on the distal end 36 at or near the tip portion 34 when the dielectric coating 32 around the electrode 33 is intact. The plasma discharge streamers 37 interact with and ignite the cylinder charge, which combusts in the combustion chamber 16 to generate mechanical power. The plasma discharge streamers 37 are low-temperature plasma streamers that may draw relatively lower currents, e.g., less than 10 mA in one embodiment.

One of the plasma igniters 30 may experience a fault wherein the dielectric coating 32 that covers the tip portion 34 of the electrode 33 is punctured, fractured or otherwise eroded or removed such that an in-cylinder fuel/air charge is directly exposed to a portion of the electrode 33. A plasma igniter 30 that has a fault in the dielectric coating 32 that covers the tip portion 34 of the electrode 33 tends to exhibit an electrical discharge in the form of a single electric arc 38 between the cylinder head 18 and a location of a fault 39 in the tip portion 34 of the electrode 33, as visually depicted with reference to FIG. 4. Furthermore, the plasma igniter 30 may instead experience a fault wherein the dielectric coating 32 that covers the tip portion 34 of the electrode 33 remains substantially intact, but nonetheless produces a single electric arc 38 during a plasma discharge event. When the plasma ignition controller 50 applies a high-frequency, high-voltage electrical pulse to the electrode 33 during a plasma discharge event during engine operation, the fuel/air charge may be directly exposed to the single electric arc 38, thus affecting combustion. Such a fault with a plasma igniter 30 may result in a change in the combustion characteristics as compared to other cylinders of the engine 100. Such a fault may not be manifested as a combustion misfire event or a partial combustion burn event. A single electric arc 38 that is associated with a fault 39 in the tip portion 34 of the electrode 33 may be a high-temperature discharge arc that may draw relatively higher currents, e.g., greater than 50 mA in one embodiment.

The controller, e.g., the ECM 60 or the plasma ignition controller 50, may include executable code that monitors the electrical signal that is output from the current sensor 53 disposed to monitor the electric cable 52 to detect electrical current that is supplied from the plasma ignition controller 50 to the plasma igniter 30. Signal conditioning e.g., in the form of filtering may be applied to the electrical signal.

Figure 2:
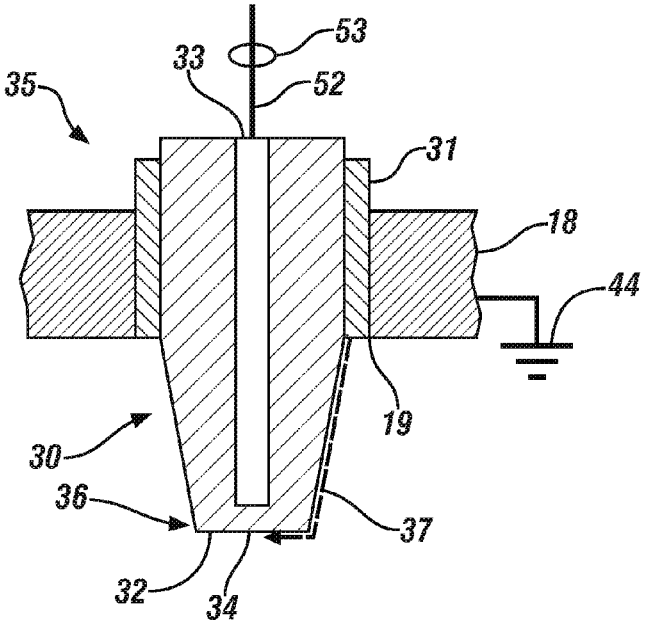
FIG. 2 schematically illustrates a cross-sectional side view of an in-cylinder groundless dielectric barrier-discharge plasma igniter mounted in a pass-through aperture of a cylinder head of an internal combustion engine, in accordance with the disclosure.
Figure 5:
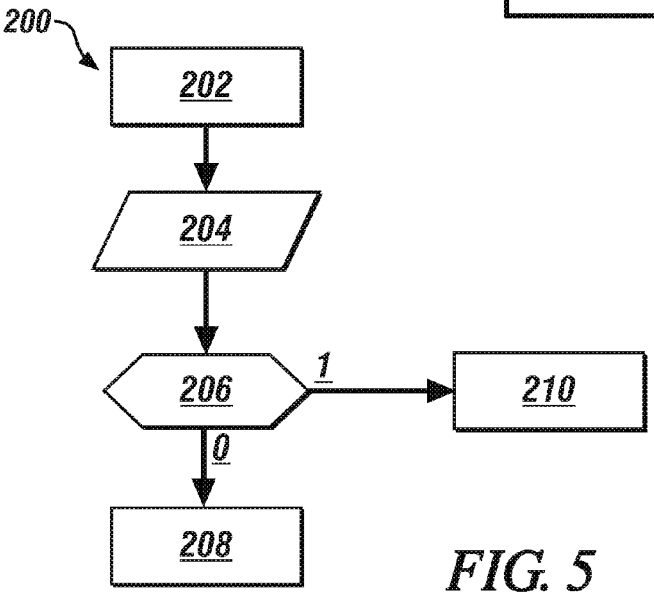
FIG. 5 schematically illustrates a block diagram of a flowchart for detecting a fault associated with a groundless dielectric barrier-discharge plasma igniter, in accordance with the disclosure.

FIG. 5 schematically shows a fault monitoring routine 200 that includes monitoring an embodiment of the engine 100 described with reference to FIG. 1 including the plasma ignition controller 50 and the plasma igniter 30 described with reference to FIG. 2. The fault monitoring routine 200 may be a stand-alone routine, or alternatively may be executed in conjunction with monitoring engine operating conditions and combustion strategies. Table 1 is provided as a key wherein the numerically labeled blocks and the corresponding functions are set forth as follows, corresponding to the fault monitoring routine 200.

TABLE 1

| BLOCK | BLOCK CONTENTS |
|---|---|
| 202 | Initiate plasma discharge |
| 204 | Monitor operating conditions and secondary current |
| 206 | Compare secondary current with threshold |
| 208 | No fault |
| 210 | Fault detected |

The fault monitoring routine 200 may be implemented in the ECM 60 as a computer-readable instruction set to monitor the secondary current and detect a fault associated with the plasma igniter 30 when the signal output from the current sensor 53 indicates a secondary current that is greater than a threshold current. In one embodiment, the threshold current is associated with a current that indicates occurrence of a single electric arc 38 across the plasma igniter 30. The threshold current may be specific to engine operating conditions, including, by way of non-limiting examples, speed, load, and operating temperature.

Execution of the fault monitoring routine 200 may proceed as follows. The steps of the fault monitoring routine 200 may be executed in any suitable order, and are not limited to the order described with reference to FIG. 5. The fault monitoring routine 200 may execute periodically, including executing in conjunction with each plasma discharge event, or alternatively, executing at a sampling rate in conjunction with selected plasma discharge events (202).

During a selected plasma discharge event, engine operating conditions and the secondary current are monitored (204). When the plasma igniter 30 has a dielectric coating 32 that is intact and the plasma igniter 30 is performing in accordance with its expected operation, there are a plurality of streamers that propagate between the cylinder head 18 and the location of the tip portion 34 of the electrode 33 during a plasma discharge event. This is illustrated with reference to FIG. 3. Correspondingly, a magnitude of the secondary current flow through the cable 52, as indicated by signal output from the current sensor 53, has a low value, which may be less than 10 mA and have a duration of 3 ms in one embodiment. When there is a fault in the dielectric coating 32 of the plasma igniter 30, a single electric arc 38 may propagate between the cylinder head 18 and the location of the fault 39 in the tip portion 34 of the electrode 33 during occurrence of a plasma discharge event. This is illustrated with reference to FIG. 4. Correspondingly, the magnitude of the secondary current flow through the cable 52, as indicated by a signal output from the current sensor 53, has a high value, which may be greater than 50 mA and have a duration of 3 ms in one embodiment.

When the engine 100 is operating under stoichiometric air/fuel ratio conditions, a fault associated with the plasma igniter 30 may be indicated by monitoring combustion phasing in conjunction with monitoring the secondary current. By way of example, combustion phasing during stoichiometric engine operation with a fault associated with the plasma igniter 30 may be retarded as compared to engine operation without a fault associated with the plasma igniter 30.

When the engine 100 is operating at lean air/fuel ratio conditions, a fault associated with the plasma igniter 30 may also be indicated by monitoring combustion phasing in conjunction with monitoring secondary current. By way of example, combustion phasing during lean engine operation with a fault associated with the plasma igniter 30 may be retarded as compared to engine operation without a fault associated with the plasma igniter 30, primarily due to an inability to generate a robust flame kernel as well as generate radicals necessary for enhancing reactivity. Furthermore, employing a plasma igniter 30 to generate pre-strike discharge events to generate radicals may cause pre-ignition events and early ignition.

The measured magnitude of the secondary current flow is compared to a threshold current level, wherein the threshold current level is determined based upon the monitored engine operating conditions (206). When the secondary current flow is less than the threshold current level (206)(0), the results indicate that there is no fault associated with the plasma igniter 30 (208). When the secondary current flow is greater than the threshold current level (206)(1), the results indicate that there is a fault associated with the plasma igniter 30 (210). Corrective action may include illuminating a malfunction indicator lamp to inform a vehicle operator, and other suitable actions.

Groundless dielectric barrier-discharge plasma igniters such as the plasma igniters 30 described herein are enabling technologies for dilute combustion engines, which may facilitate improved engine efficiency and reduced exhaust emissions. The concepts described herein facilitate implementation of groundless dielectric barrier-discharge plasma igniters.

The detailed description and the drawings or figures are supportive and descriptive of the present teachings, but the scope of the present teachings is defined solely by the claims. While some of the best modes and other embodiments for carrying out the present teachings have been described in detail, various alternative designs and embodiments exist for practicing the present teachings defined in the appended claims.

The invention claimed is:

1. An internal combustion engine, comprising:

a cylinder block, a cylinder head and a piston cooperating to form a combustion chamber in a cylinder bore of the cylinder block;

a plasma ignition controller electrically connected to a groundless barrier discharge plasma igniter, wherein the groundless barrier discharge plasma igniter includes a tip portion disposed to protrude into the combustion chamber;

a current sensor disposed to monitor a secondary current flow between the plasma ignition controller and the groundless barrier discharge plasma igniter;

the plasma ignition controller disposed to execute a plasma discharge event in the combustion chamber via the groundless barrier discharge plasma igniter; and a controller disposed to monitor a magnitude of the secondary current flow via the current sensor during the plasma discharge event, wherein the controller includes an instruction set, the instruction set executable to evaluate integrity of the groundless barrier discharge plasma igniter based upon the magnitude of the secondary current flow during the plasma discharge event.

2. The internal combustion engine of claim 1, further comprising the instruction set executable to determine a peak value for the magnitude of the secondary current flow during the plasma discharge event, and detect a fault in the groundless barrier discharge plasma igniter when the peak value for the magnitude of the secondary current flow during the plasma discharge event is greater than a threshold level.

3. The internal combustion engine of claim 2, wherein the threshold level is associated with a magnitude of the secondary current flow that indicates occurrence of a single electric arc on a surface of the groundless barrier discharge plasma igniter.

4. The internal combustion engine of claim 1, wherein the groundless barrier discharge plasma igniter comprises an electrode including a tip portion that is encapsulated in a dielectric material.

5. The internal combustion engine of claim 1, wherein the plasma ignition controller electrically connects to an electrical ground path that is connected to the cylinder head.

6. The internal combustion engine of claim 1, wherein the plasma ignition controller disposed to execute a plasma discharge event in the combustion chamber via the groundless barrier discharge plasma igniter comprises the plasma ignition controller disposed to apply a high-frequency, high-voltage electrical pulse to the groundless barrier discharge plasma igniter.

7. The internal combustion engine of claim 6, wherein the plasma ignition controller disposed to apply a high-frequency, high-voltage electrical pulse to the groundless barrier discharge plasma igniter comprises the plasma ignition controller configured to apply an electrical pulse having a frequency near 1 megahertz at a voltage in the range of 10 to 70 kilovolts to the groundless barrier discharge plasma igniter.

8. A method for monitoring a plasma ignition system including a plasma ignition controller electrically connected to a groundless barrier discharge plasma igniter, wherein the groundless barrier discharge plasma igniter includes a tip portion disposed in a combustion chamber of an internal combustion engine, the method comprising:

monitoring electric current flow between the plasma ignition controller and the groundless barrier discharge plasma igniter during a plasma discharge event;

determining, via a controller disposed to monitor the electric current flow between the plasma ignition controller and the groundless barrier discharge plasma igniter, a peak secondary current flow based upon the monitored electric current flow; and evaluating integrity of the groundless barrier discharge plasma igniter based upon the peak secondary current flow.

9. The method of claim 8, wherein evaluating integrity of the groundless barrier discharge plasma igniter based upon the peak secondary current flow comprises detecting a fault in the groundless barrier discharge plasma igniter when the peak secondary current flow is greater than a threshold current.

10. The method of claim 9, wherein the threshold current is associated with a magnitude of the secondary current flow that indicates occurrence of a single electric arc on a surface of the groundless barrier discharge plasma igniter.

11. The method of claim 8, further comprising:

operating the internal combustion engine at a stoichiometric air/fuel ratio;

monitoring combustion phasing; and evaluating integrity of the groundless barrier discharge plasma igniter based upon the peak secondary current flow and the combustion phasing.

12. The method of claim 11, wherein evaluating integrity of the groundless barrier discharge plasma igniter based upon the peak secondary current flow and the combustion phasing comprises detecting a fault in the groundless barrier discharge plasma igniter when the peak secondary current flow is greater than a threshold current and the combustion phasing is retarded.

13. The method of claim 8, further comprising:

operating the internal combustion engine at a lean air/fuel ratio;

monitoring combustion phasing; and evaluating integrity of the groundless barrier discharge plasma igniter based upon the peak secondary current flow and the combustion phasing.

14. The method of claim 13, wherein evaluating integrity of the groundless barrier discharge plasma igniter based upon the peak secondary current flow and the combustion phasing comprises detecting a fault in the groundless barrier discharge plasma igniter when the peak secondary current flow is greater than a threshold current and the combustion phasing is retarded.

15. A method for monitoring a plasma ignition system for an internal combustion engine, wherein the plasma ignition system includes a plasma ignition controller electrically connected to a groundless barrier discharge plasma igniter, wherein the groundless barrier discharge plasma igniter includes an electrode that includes a tip portion that is encapsulated in a dielectric material and disposed in a combustion chamber of the internal combustion engine, the method comprising:

executing a plasma discharge event during an engine combustion cycle;

monitoring electric current flow between the plasma ignition controller and the groundless barrier discharge plasma igniter during the plasma discharge event;

determining, via a controller disposed to monitor the electric current flow between the plasma ignition controller and the groundless barrier discharge plasma igniter, a peak secondary current flow based upon the monitored electric current flow; and evaluating integrity of the groundless barrier discharge plasma igniter based upon the peak secondary current flow.

16. The method of claim 15, wherein evaluating integrity of the groundless barrier discharge plasma igniter based upon the peak secondary current flow comprises detecting a fault in the groundless barrier discharge plasma igniter when the peak secondary current flow is greater than a threshold current.

17. The method of claim 16, wherein the threshold current is associated with a magnitude of the secondary current flow that indicates occurrence of a single electric arc on a surface of the groundless barrier discharge plasma igniter.

18. The method of claim 15, wherein the plasma ignition controller electrically connects to an electrical ground path connected to the cylinder head.

19. The method of claim 15, further comprising:

operating the internal combustion engine at a stoichiometric air/fuel ratio;

monitoring combustion phasing;

evaluating integrity of the groundless barrier discharge plasma igniter based upon the peak secondary current flow and the combustion phasing; and detecting a fault in the groundless barrier discharge plasma igniter when the peak secondary current flow is greater than a threshold current and the combustion phasing is retarded.

20. The method of claim 15, further comprising:

operating the internal combustion engine at a lean air/fuel ratio;

monitoring combustion phasing;

evaluating integrity of the groundless barrier discharge plasma igniter based upon the peak secondary current flow and the combustion phasing; and detecting a fault in the groundless barrier discharge plasma igniter when the peak secondary current flow is greater than a threshold current and the combustion phasing is retarded.

* * * * *